US007841113B2

(12) United States Patent
Chapin

(10) Patent No.: US 7,841,113 B2
(45) Date of Patent: Nov. 30, 2010

(54) HOUSING FOR REFRIGERATED DISPENSING APPARATUS

(75) Inventor: Michael L. Chapin, New York, NY (US)

(73) Assignee: Tap Machine Inc., New Rochelle, NY (US)

( * ) Notice: Subject to any disclaimer, the term of this patent is extended or adjusted under 35 U.S.C. 154(b) by 225 days.

(21) Appl. No.: 12/142,116

(22) Filed: Jun. 19, 2008

(65) Prior Publication Data

US 2009/0313868 A1 Dec. 24, 2009

(51) Int. Cl.
*B67D 7/80* (2010.01)
*G09F 13/18* (2006.01)

(52) U.S. Cl. ..... 40/312; 40/546; 222/146.6

(58) Field of Classification Search ..... 40/546, 40/544, 564; 222/146.6; 362/235, 600
See application file for complete search history.

(56) References Cited

U.S. PATENT DOCUMENTS

| | | | | |
|---|---|---|---|---|
| 5,427,276 | A | 6/1995 | Knuettel, II et al. | |
| 5,456,387 | A | 10/1995 | Trewhella | |
| 5,494,195 | A | 2/1996 | Knuettel, II et al. | |
| 6,460,580 | B1 * | 10/2002 | Cunha et al. | 141/196 |
| 6,530,164 | B2 * | 3/2003 | Gai | 40/546 |
| 2004/0004827 | A1 * | 1/2004 | Guest | 362/31 |

* cited by examiner

*Primary Examiner*—Cassandra Davis
(74) *Attorney, Agent, or Firm*—Ladas & Parry LLP

(57) ABSTRACT

A bar-top refrigerated liquid dispenser in which one or more housing walls include integrated back-lighted billboard display panels having side edges with embedded light emitting diodes and other edges with associated reflectors.

7 Claims, 4 Drawing Sheets

HOUSING FOR REFRIGERATED DISPENSING APPARATUS

The present invention relates generally to bar-top refrigerated dispensing apparatuses and specifically to improvements in the housings therefor, particularly for advertising displays incorporated therein.

BACKGROUND OF THE INVENTION

Bar top refrigerating-dispensing apparatus has become well known and very popular in the restaurant industry for displaying an alcoholic beverage to be dispensed to customers while simultaneously providing a chilling apparatus and a dispenser for dispensing the chilled alcoholic beverage on site simply and efficiently.

Examples of bar top dispensing apparatus are the subject matter of a series of U.S. patents, namely, U.S. Pat. Nos. 5,494,195; 5,456,387; and 5,427,276, the disclosures of which are incorporated by reference herein.

The apparatus disclosed in the aforementioned patent disclosures all include a housing which generally encloses the refrigeration apparatus and mounts a dispensing spigot on one face thereof with an activating mechanism, typically a handle or lever-type paddle to turn a faucet on and off for the purposes of dispensing a beverage such as a chilled liqueur, and importantly for the purposes of promoting the sale of the dispensed liquor, includes a series of inverted bottles of the particular beverage being chilled and dispensed.

It is to a new and improved housing having integrated lighted display panels that the present invention is specifically directed.

SUMMARY OF THE INVENTION

While the apparatus shown in the prior art patents referenced herein has proved effective as a dispenser and on site promotional display, in large measure due to the prominent display of inverted bottles of the dispensed product itself, enhancement of the point-of-purchase function of the apparatus has been sought and obtained in small measure by applying advertising messages to the exterior surfaces of the housing.

The present invention provides an integral, brightly lighted advertising display to the exterior walls of the dispenser housing in a simple and efficient manner.

Specifically, a housing for enclosing the refrigeration apparatus is provided with a series of openings or display windows, each of which is closed by a clear ABS or clear acrylic glass panel or pane. A translucent sheet of advertising is juxtaposed and lighted by a back-lighting panel having at least one edge with embedded LEDs (light emitting diodes) and having light reflectors disposed along the remaining edges to focus and intensify the internal lighting of the back-lighting panels.

The back-lighting effect is further enhanced by a grid or pattern of light-refracting dots formed on an outer surface of the back-lighting panel while a white reflector sheet is secured to the other face of the back-lighting panel.

The housing frame itself may be fabricated from molded ABS polycarbonate panels or the like into which the window panel, translucent advertising sheet, and back-lighting panel may be inserted as a sub-assembly and secured firmly in place by a bracket fastened to the frame.

The LEDs may be selected of various colors to provide, as desired or necessary, specific colors for lighting the translucent material.

For a more complete understanding of the present invention and for a better appreciation of its attendant advantages, reference should be made to the following detailed description, taken in conjunction with the drawings.

DETAILED DESCRIPTION OF THE INVENTION

Figure 4:
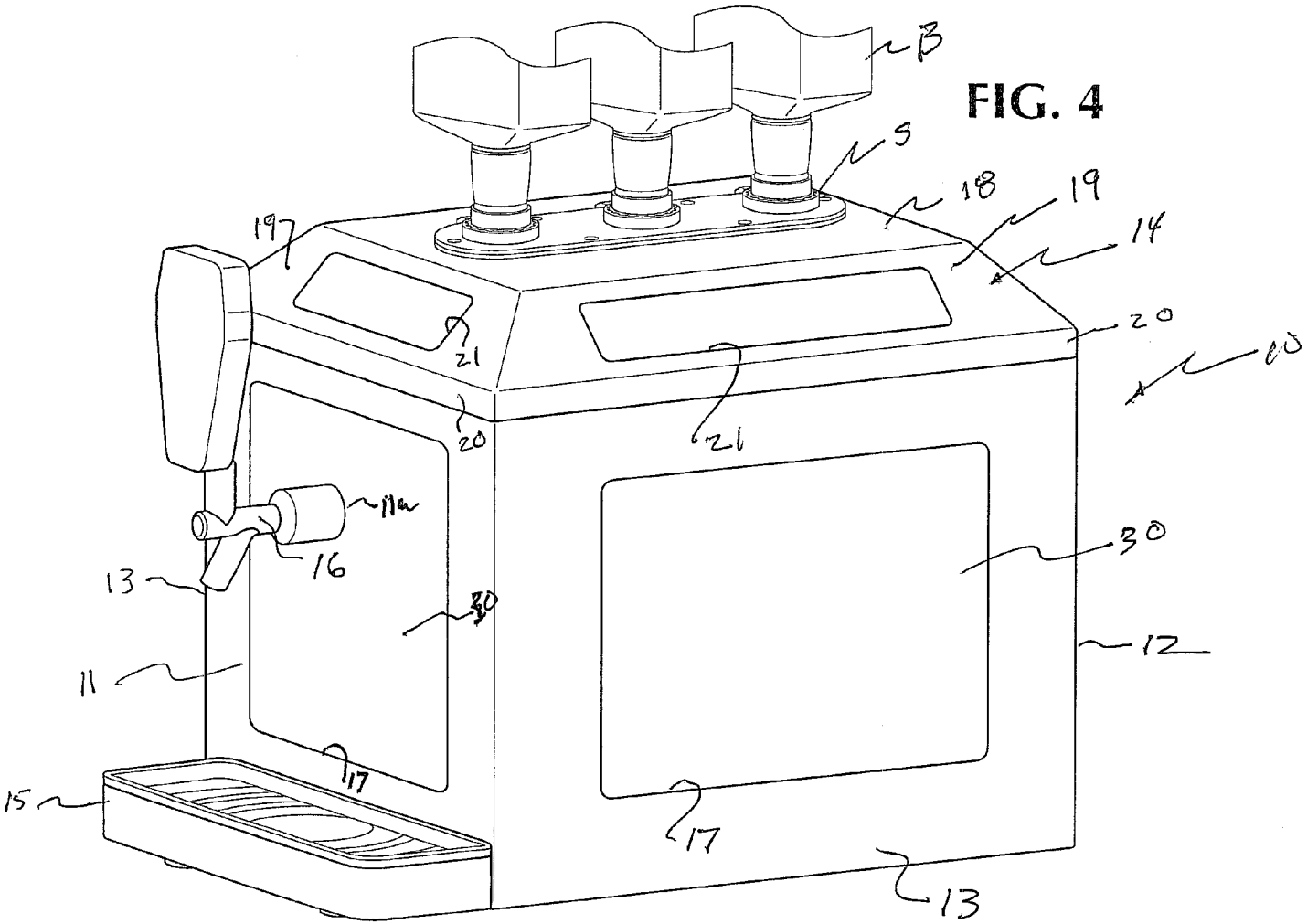
FIG. 4 is a perspective view of a housing for a refrigerated dispenser in which lighted display windows are integrated into the top cover and side walls in accordance with the principles of the invention.

Referring initially to FIG. 4, the present invention is in the nature of an improved housing 10 for refrigerated dispensing apparatuses of the types shown and described in U.S. Pat. Nos. 5,494,195; 5,456,387; and 5,427,276, the disclosures of which are incorporated by reference herein. Thus, the housing forms an enclosure with front, rear, side, top, and bottom surfaces, the dimensions of which establish a housing suitable for placement on a bar top or countertop. Typically, and as disclosed in the referenced patents, the dispensing apparatus includes a refrigeration cooling unit having a compressor, condenser, and evaporator coil. A mounting system 5 for supporting displayed, inverted liqueur bottles B is included at the top for permitting warm fluid to drain from the bottles and to flow through a cooler within the housing for ultimate dispensing as a chilled beverage through a faucet mounted on the front of the housing.

To enhance the advertising and promotion of the product being dispensed (or to promote some other sponsor), a new and improved housing has been developed having housing wall panels which function also as brightly lighted billboards.

Specifically, the new and improved housing 10 for a refrigerated dispenser (FIG. 4) has an individual front wall 11, an opposite parallel rear wall 12, opposite side walls 13 therebetween, and a molded cover 14 in the form of a truncated pyramid with a horizontal upper wall 18 and four sloped walls 19 with vertical lips 20. A bottom tray to which the walls 11, 12, 13 are secured supports the entire refrigerated dispensing unit. An overflow or spill tray 15 may be attached to the front wall beneath the faucet 16 which penetrates wall 11 through opening 11*a* in pane 30. The walls 11-14 may be interconnected or interlocked into the housing 10 by mechanical fasteners, integral male-female connectors, and/or adhesive, as desired.

In accordance with the invention, the walls 11, 13 include a windows 17 for mounting back-lighted advertising or promotional display matter therein and the walls 19 include windows 21 for the same purpose.

The housing walls are all molded of lightweight, strong and rigid ABS polycarbonate material. The walls in which the windows 17 and 21 are formed are exemplified by side wall panel 13 shown in FIGS. 1 and 2. The walls panels 11-13 all have planar outer surfaces and vertical reinforcing ribs 22 and horizontal reinforcing ribs 23 integrally formed therewith. A recess 17*a* is formed circumscribing the window 17 to receive the pane 30 in nesting fashion. A similar recess is formed for the windows 21 in cover walls 19. The top cover 14 is molded as a single dome-like unit for the four upstanding walls 11-13 and it also includes similar integral reinforcing ribs. In those walls which have windows, and in the cover panel adjacent the windows 21, bosses 24 are formed integrally with the ribs with threaded holes 25.

The windows 17 and 21 are each closed by a clear acrylic glass or ABS polycarbonate pane 30, superimposed upon which is a translucent sheet 31 of decorative and/or informational material to be back-lighted and displayed in the window. The translucent sheet may have opaque and clear portions illustrating, for example, the logo of the brand of liquid being dispensed or the establishment in which the dispenser is being used or even pricing information for a unit of dispensed beverage.

The translucent sheet material is superimposed with a back-lighting panel 50 for lighting the clear or translucent portions of the sheet 31.

Figure 1:
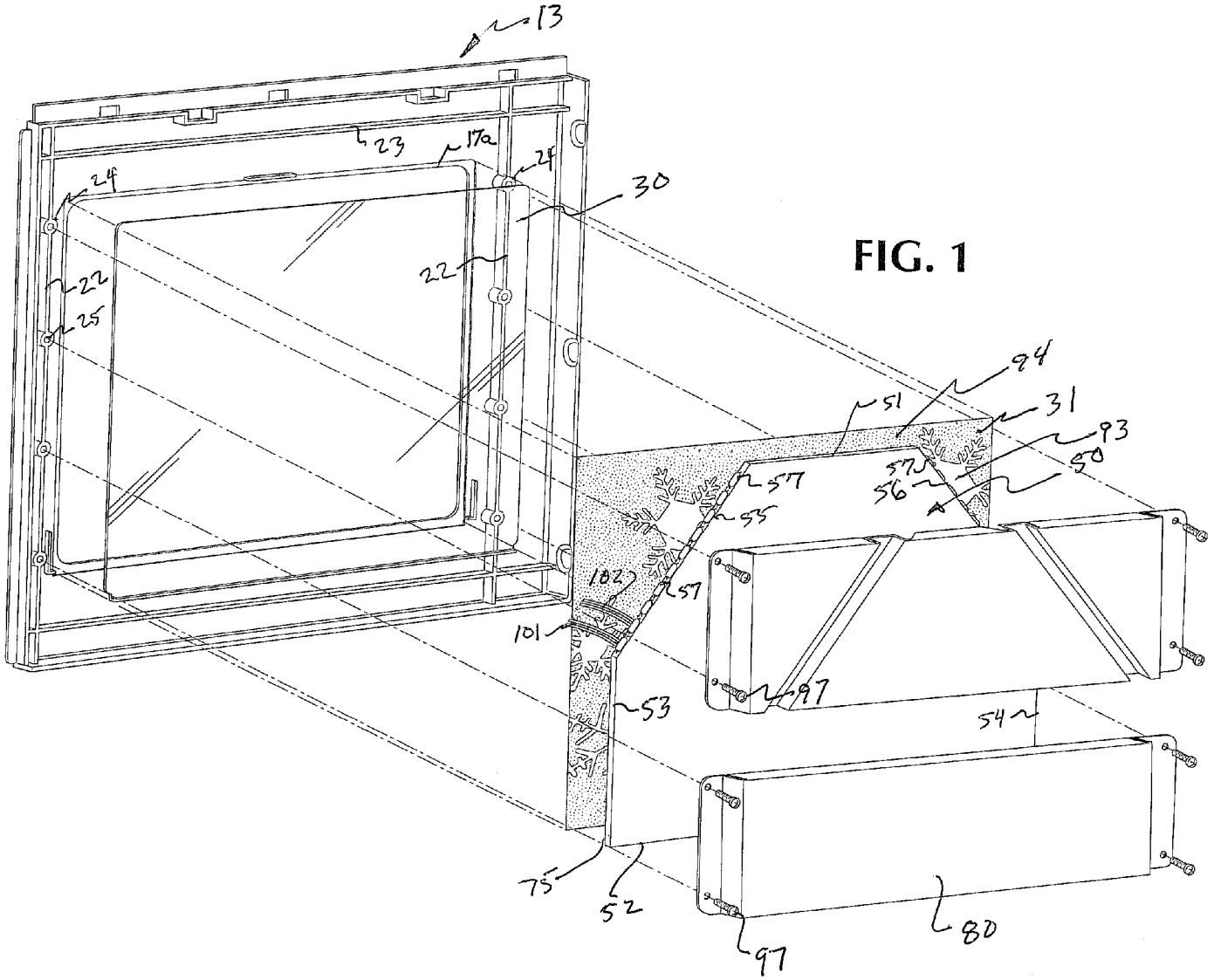
FIG. 1 is an exploded perspective view of the new and improved lighted housing wall panel sub-assembly.

The backlighting panel 50 in FIG. 1 is shown in the shape of an irregular hexagon having parallel short top and long bottom edges 51, 52; parallel vertical side edges 53, 54; and slanted side edges 55, 56. The slanted edges 55, 56 support a series of miniature light sources in the form of light-emitting diodes (LEDs) 57 in milled slots, such slots shown in FIG. 3. If desired, the panel 50 may be rectangular or square with equal length top and bottom edges with the LEDs disposed along the entire opposite vertical side edges in the manner of panel 60 shown in FIG. 3.

Figure 3:
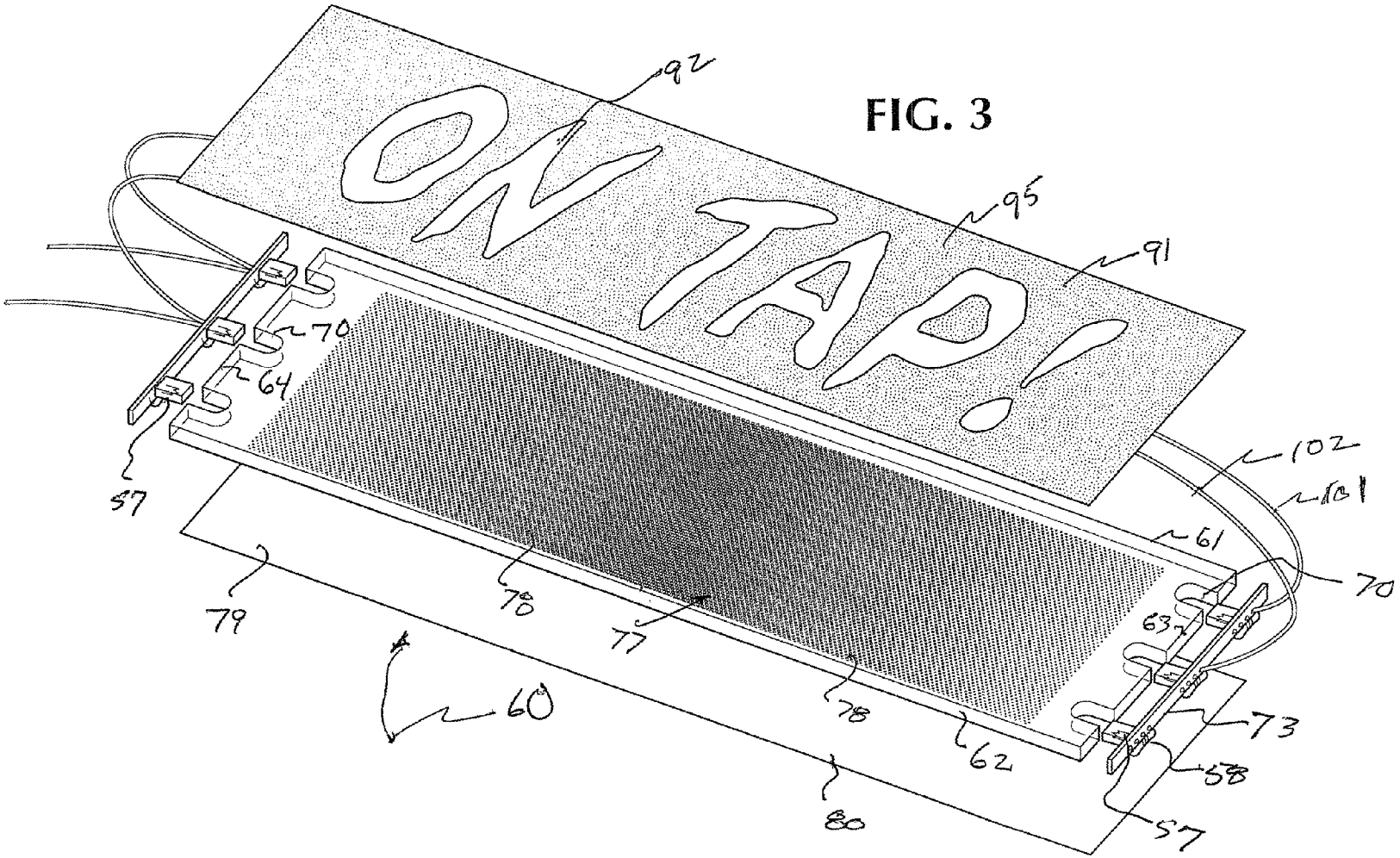
FIG. 3 is an exploded perspective view of display and lighting elements employed in the new and improved housing.

The back-lighting panel 60 in FIG. 3 is rectangular in shape having parallel long top and bottom edges 61, 62; and parallel short sides 63, 64. The panel 60 is used to light windows 21 in the cover 14.

The back-lighting panels 50, 60 each have milled slots 70, formed on side edges 55, 56 and 63, 64, respectively, for receiving LEDs 57 connected in series with capacitors 58 on LED strips 73. The precise number of LEDs for the back-lighting panels may be varied depending upon the overall size and shape of the panels, as will be understood. For an approximate 2"×6" rectangular panel, three LEDs on opposing sides is sufficient. For a larger rectangular panel, for example one being approximately 7"×11," fifteen LEDs on opposite side edges is sufficient.

The LEDs may be white light or a red light or a blue light as desired for a particular effect, or a combination of colored LEDs may be used to achieve colored lighting other than red, white, and/or blue.

To maximize or to otherwise enhance the brightness of the LED lighting, the edges of the panels 50, 60 remote from the LEDs inserted in milled slots 70 are covered with reflective foil 75 laminated thereto by adhesive; the rear surfaces of the panels 50, 60 are treated to establish a lenticular pattern 77 of dots 78, each of which is a miniature lens; and a white reflective backing sheet 79 is superimposed over the lenticular pattern and is adhesively bonded thereto at its circumference 80.

Figure 2:
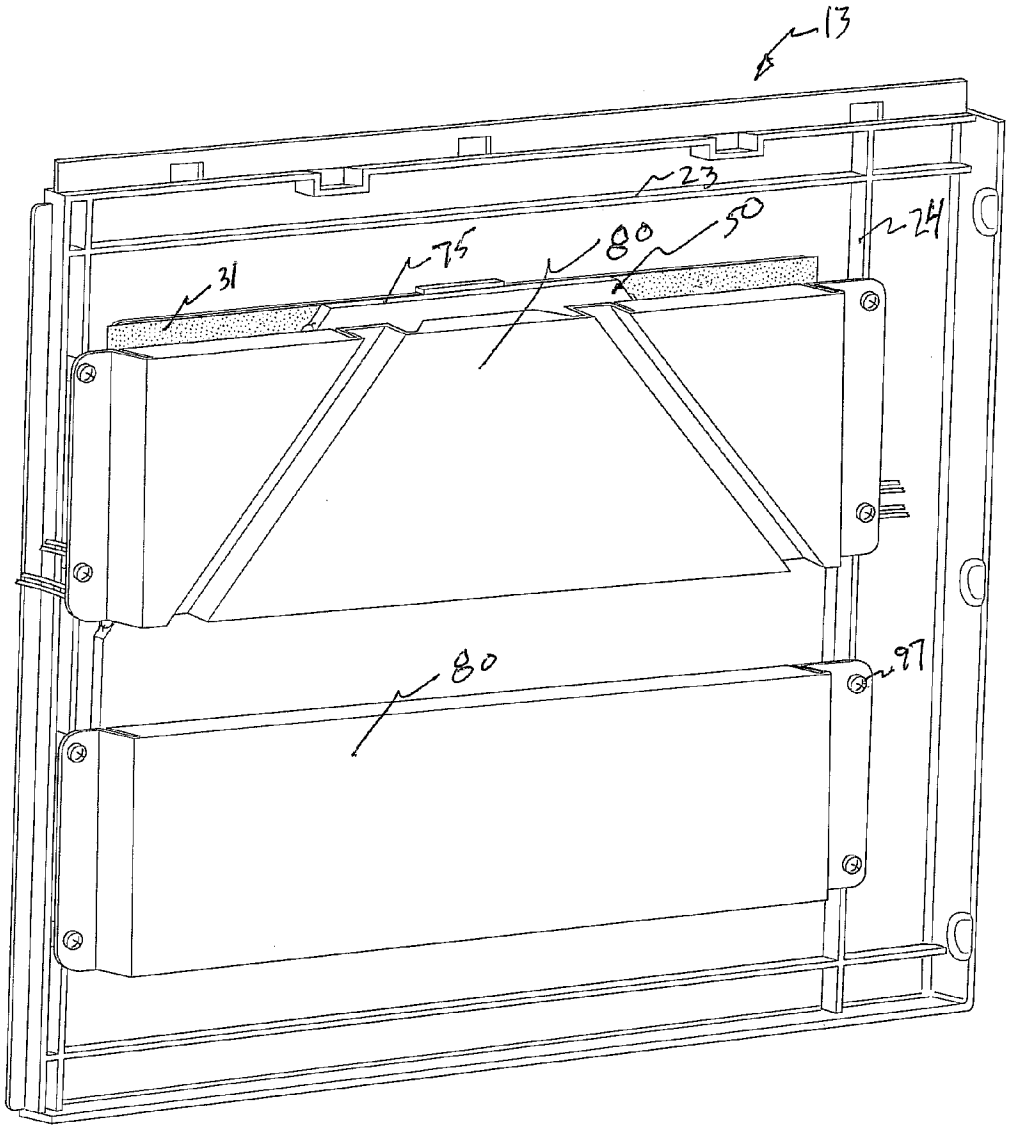
FIG. 2 is a perspective view of an assembled wall panel assembly.

In accordance with the invention, translucent display sheets 31, 91 advantageously fabricated from lightweight paper or plastic having a design with clear regions 92, 93 and opaque or semi-opaque regions 94, 95 are mounted in the windows 17, 21 of the housing and are sandwiched between the acrylic glass window panels 30 and the back-lighting panels 50, 60 by bracket members 80 (such as shown in FIG. 1) which engage the rear surfaces of panels 50, 60 and clamp them firmly in place. The bracket members 80 may be a suitable rigid material such as galvanized steel, aluminum, or plastic and are secured to the panels by screws 97 which are seated in the holes 25 in the bosses 24 formed in the molded panels such as shown in FIGS. 1 and 2.

The LEDs in the panels are energized by direct current (DC) supplied thereto through leads 101, 102. Appropriate transformer circuitry is contained within the housing to convert alternating current (AC) supplied to the dispenser unit for operating the refrigeration apparatus as will be understood.

With the practice of the present invention, the bar top refrigerated dispensers of the type known to the art are greatly enhanced as a promotional or marketing tool for the beverage being dispensed by the incorporation of brilliantly lighted "billboard-like" panels directly into the housing structure itself as integral portions of the housing walls. The advantageous benefits of the new housing are achieved without sacrifice of strength of the units and without adding undue weight to the entire refrigerated dispenser.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A housing for a beverage dispensing unit having a plurality of interconnected walls enclosing beverage treatment apparatus, said housing having at least one lighted billboard comprising:

(a) a polycarbonate planar wall panel defining a window opening;

(b) a clear acrylic glass pane closing said window opening;

(c) a translucent display sheet of graphics disposed in said window opening;

(d) a back-lighting panel of clear polycarbonate superimposed upon said display sheet;

(e) said back-lighting panel including a plurality of edge portions;

(f) a plurality of slots formed along at least one edge portion;

(g) an LED disposed in at least one of said slots;

(h) connecting means affix said back-lighting panel to said wall panel;

(i) said back-lighting panel includes reflective foil adhered to edge portions remote from said slots;

(j) a reflecting sheet is adhered to the rear surface of said back-lighting panel; and (k) a pattern of lenticular reflectors is formed on the rear surface of said back-lighting panel.

2. The housing of claim 1, further including:

(a) bottle support means mounted on said housing above said lighted billboard.

3. The housing of claim 1, further including:

(a) a faucet means mounted on a wall of said housing.

4. The housing of claim 1, in which said housing includes:

(a) an individual vertical front wall, an opposite vertical parallel rear wall, opposite vertical side walls therebetween, and (b) a molded cover in the form of a truncated pyramid with a horizontal upper wall and four sloped walls.

5. A lighted billboard subassembly for promotional display apparatus comprising:

(a) a polycarbonate planar wall panel defining a window opening;

(b) a clear acrylic glass pane closing said window opening;

(c) a translucent display sheet of graphics disposed in said window opening;

(d) a back-lighting panel of clear polycarbonate superimposed upon said display sheet;

(e) said back-lighting panel including a plurality of edge portions;

(f) a plurality of slots formed along at least one edge portion;

(g) an LED disposed in at least one of said slots;

(h) connecting means affix said back-lighting panel to said wall panel;

(i) said back-lighting panel includes reflective foil adhered to edge portions remote from said slots;

(j) a reflector sheet is adhered to the rear surface of said back-lighting panel;

(k) a pattern of lenticular reflectors is formed on the rear surface of said back-lighting panel.

6. The housing of claim 4, in which:

(a) bottle support means are mounted on the upper horizontal wall of said cover.

7. The housing of claim 6, further including:

(a) a faucet means mounted on one of said vertical walls.

* * * * *